US009062946B2

(12) United States Patent
Cousin et al.

(10) Patent No.: US 9,062,946 B2
(45) Date of Patent: Jun. 23, 2015

(54) REVERSIBLE DETONATING PYROTECHNIC RUPTURE PIECE

(75) Inventors: Jean-Yves Cousin, Armentieres (FR); Thomas Kister, Vaux sur Seine (FR); Pascal Lesaulnier, Puteaux (FR)

(73) Assignee: ASTRIUM SAS, Suresnes (FR)

( * ) Notice: Subject to any disclaimer, the term of this patent is extended or adjusted under 35 U.S.C. 154(b) by 114 days.

(21) Appl. No.: 13/996,402

(22) PCT Filed: Dec. 12, 2011

(86) PCT No.: PCT/FR2011/052941

§ 371 (c)(1),
(2), (4) Date: Sep. 13, 2013

(87) PCT Pub. No.: WO2012/085389

PCT Pub. Date: Jun. 28, 2012

(65) Prior Publication Data

US 2013/0340644 A1 Dec. 26, 2013

(30) Foreign Application Priority Data

Dec. 22, 2010 (FR) ..... 10 05043

(51) Int. Cl.
*F42B 15/38* (2006.01)

(52) U.S. Cl.
CPC ..... *F42B 15/38* (2013.01)

(58) Field of Classification Search
CPC ..... F42B 15/36
USPC ..... 102/378; 89/1.14
See application file for complete search history.

(56) References Cited

U.S. PATENT DOCUMENTS

| | | | | |
|---|---|---|---|---|
| 3,230,885 | A | 1/1966 | Weber et al. | |
| 5,969,287 | A | 10/1999 | Blain et al. | |
| 2003/0196544 | A1 | 10/2003 | Comtesse | |
| 2013/0199359 | A1 * | 8/2013 | Kister et al. | 89/1.14 |

FOREIGN PATENT DOCUMENTS

| | | |
|---|---|---|
| DE | 3833698 | 4/1990 |
| FR | 2888926 | 1/2007 |

* cited by examiner

*Primary Examiner* — Reginald Tillman, Jr.
(74) *Attorney, Agent, or Firm* — Duane Morris LLP; J. Rodman Steele, Jr.; Gregory M. Lefkowitz

(57) ABSTRACT

According to the invention, this piece comprises: a base section piece (1) provided with a projecting longitudinal heel (4) delimiting a longitudinal groove (7); a longitudinal pyrotechnic cord laid in said groove; and a plurality of consecutive section piece portions (2) fixed one after the other to said base section piece (1) by first fixing means (9). Between the consecutive section piece portions (2) are second fixing means (18), distributed along said base section piece (1) and independent of said first fixing means (9), enabling said pyrotechnic cord to be fixed and positioned relative to said base section piece (1).

6 Claims, 2 Drawing Sheets

REVERSIBLE DETONATING PYROTECHNIC RUPTURE PIECE

CROSS-REFERENCE TO RELATED APPLICATIONS

This application is a §371 national stage entry of International Application No. PCT/FR2011/052941, filed Dec. 12, 2011, which claims priority to French Patent Application No. 10/05043 filed Dec. 22, 2010, the entire contents of which are incorporated herein by reference.

The present invention concerns a detonating pyrotechnic separation part, particularly but not exclusively appropriate for use in space launch vehicles. It will be described below more specifically in this latter application.

It is known that some elements of space launch vehicles, such as adjacent stages, are connected to one another mechanically by a structural part intended to ensure the transmission of mechanical forces between said elements for as long as this is necessary and provided with detonating pyrotechnic separation means, incorporated into said structural part and able to break along a rectilinear or curvilinear line of separation, when said elements must be separated from one another. Similar parts likewise enable the satellite carrier structures on board launch vehicles to be cut.

There is already known, via U.S. Pat. No. 3,230,885, a detonating pyrotechnic separation part of this kind, with:

- a first section forming the base of said part and provided with a hook-shaped projecting longitudinal heel and with a longitudinal channel disposed in the concavity of said heel;
- a longitudinal pyrotechnic fuse disposed in said channel; and
- a second section attached to said first section, cooperating with said heel in order to close said channel and serving as the anvil to said pyrotechnic fuse.

Thus, theoretically, when said pyrotechnic fuse is ignited, it produces a detonation which breaks said first section at the channel.

However, as has been explained in French patent application number 05 07800 filed on 22 Jul. 2005 in the name of the applicant, for the operation of such a pyrotechnic detonating separation part to be reliable, it is necessary:

- that said first section has a projecting longitudinal rib against which said second section rests, via blocks, in order to prevent the chamber formed by said channel from opening at the moment of detonation;
- that said heel has, on the inner face of its free end, a first plane longitudinal facet divergently inclined towards the exterior of the hook formed by the heel and that said second section is provided, on the outer face of its longitudinal edge opposite said rib, with a convergently-inclined second plane longitudinal facet, which is disposed opposite said first facet while being distant from it by a first predetermined clearance, allowing said second facet to cooperate with said first facet, when said part ruptures, in order to allow the two portions thereof that result from the rupture to come apart easily; and
- that, in said channel, said pyrotechnic fuse is accommodated with a second predetermined clearance, parallel to the depth of said first and second sections.

A pyrotechnic part of this kind is designed to operate nominally in a predetermined direction, for example in the direction in which the section provided with the heel is in the upper position and in which the section serving as anvil is in the lower position. In order to do so, this type of part must:

- ensure axial contact between the lower section and the longitudinal rib of the upper section via blocks, in order to maintain the integrity of the components until separation occurs and to contribute to the cutting performance;
- have a predetermined radial clearance, in order to allow the nominal radial expansion of the pyrotechnic fuse and to also contribute to said cutting performance; and
- also have a predetermined axial clearance (between the facets of the two sections), in order to allow the axial expansion of said fuse, to ensure its integrity and to position said fuse at the correct altitude in relation to the base of the channel with a view to obtaining the desired performance in terms of cutting and separation.

These three conditions can be fulfilled easily in the case where the pyrotechnic part operates only in the direction specified above. A plurality of positioning studs can be provided or the structure of the part can be bossed, the fuse being able to rest thereon under the effect of gravitation.

However, where there is a requirement to ensure the performance of this type of part regardless of its direction of use in flight conditions, it is important that the part can also operate in the opposite direction (a section with the heel in the lower position, a section serving as anvil in the upper position). However, for a given direction, there is a preferred position for the fuse, in which it rests either on the bossing of the structure or on the anvil. In the opposite direction, the axial position (or altitude) of the fuse differs from this preferred position, which can adversely affect the cutting performance insofar as the altitude of said fuse (which acts like a lever arm relative to the base of the channel, where cutting is initiated) has an effect on said performance.

For this reason, the production of a pyrotechnic separation part that is reversible (in other words, able to break in the direction in which the heel is above and in the direction in which the heel is below) involves an axial positioning of the fuse independent of the relative positioning of the two sections, and therefore both positioning and axially maintaining said fuse in the channel.

In order to do this, one solution envisaged consists of effecting the locking of the fuse directly by the section serving as anvil, equipped for that purpose with a stud and placed in contact with said fuse before the screw intended to positively connect the two sections is tightened. However, the use of a projecting longitudinal rib against which the section serving as an anvil rests, via blocks, makes it impossible to ensure that there is contact not only between the anvil and the rib (which determines the clearance between said anvil and the heel) but also between said anvil and the fuse via the positioning studs.

The aim of the present invention is to overcome these drawbacks and the invention relates to a detonating pyrotechnic separation part the pyrotechnic fuse of which can be maintained, independently of the anvil, in an identical position that is independent of the relative positioning of the two sections, with the aim of making said part reversible and capable of operating in any flight conditions.

To that end, according to the invention, the detonating pyrotechnic separation part with:

- a first section forming the base of said part and provided with a longitudinal projecting rib, and with a hook-shaped longitudinal projecting heel delimiting a longitudinal channel in its concavity, said heel having, on the inner face of its free end a first plane longitudinal facet, divergently inclined towards the exterior of the hook formed by said heel;

a longitudinal pyrotechnic fuse disposed in said channel; and a second section added to said first section and made integral therewith via first fixing means distributed along the length of said first and second sections, said second section resting, via one of its longitudinal edges, against said projecting longitudinal rib via blocks and being provided, on the outer face of its other longitudinal edge, with a convergently-inclined second plane longitudinal facet disposed opposite said first facet while being distant therefrom by a first predetermined clearance, enabling said second facet to cooperate with said first facet during the rupture of said part, said second section thus closing said channel, in which said pyrotechnic fuse is accommodated with a second predetermined clearance parallel to the depth of said first and second sections, and being capable of serving as anvil to said pyrotechnic fuse, is distinctive:

in that said second section consists of a plurality of consecutive section portions, fixed one after another onto said first section via said first fixing means; and in that there are provided, between said consecutive section portions, second fixing means, distributed along the length of said first section and independent of said first fixing means, making it possible to fix and position said pyrotechnic fuse relative to said first section.

Thus, the system for positioning and maintaining said pyrotechnic fuse inside said channel is completely independent of the system for fixing the portions of the second section onto said first section. These second fixing means perform a function of trapping the fuse in such a way as to make it integral with one of the two sections (or with one of the two pieces to be separated) at the time of the pyrotechnic rupturing, additional to the function of maintaining said fuse that is provided by the first fixing means.

So that said channel is closed laterally, it is advantageous for the opposed transverse end edges of two consecutive section portions to be at least approximately in abutment. It is therefore necessary that at least one of said transverse edges has an indentation to accommodate the corresponding second fixing means.

In an advantageous embodiment, each of said second fixing means has a rigid or semi-rigid tie which forms a loop closely surrounding said pyrotechnic fuse and the ends of which are fixed to said first section. A rigid tie of this kind can be made as a metal strip, which is able to trap the fuse.

Preferably, a spacer plate is disposed between the ends of said rigid or semi-rigid tie and both ends of said tie are fixed to the first section by at least one bolt of which the screw passes through said ends, the spacer plate and said first section and of which the nut holds said ends against said spacer plate and said first section. In addition, a positioning stud can be disposed between said spacer plate and said pyrotechnic fuse.

Preferably, arrangements are provided in the spacer plate in order to ensure some clearance at said tie and to position the second fixing means. This may, for example, involve grooves made in the blocks for holding the fuse, which prevents the tie from rotating and jamming when it is fitted.

The accompanying drawings will give a clear understanding as to how the invention can be embodied. In these drawings, identical references designate similar elements.

Figure 1:
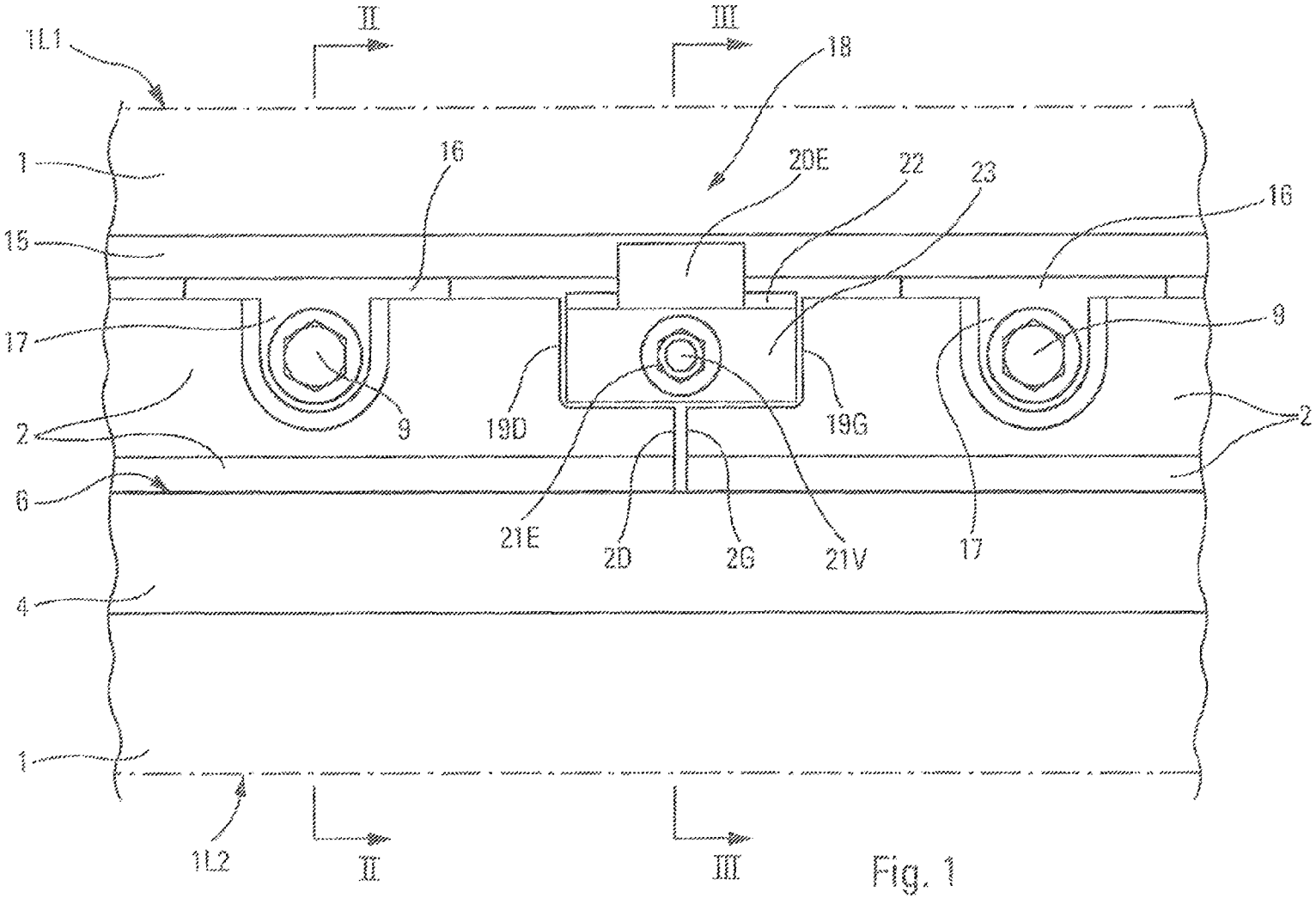
FIG. 1 is a frontal view of a longitudinal portion of the detonating pyrotechnic separation part according to the present invention.
Figure 3:
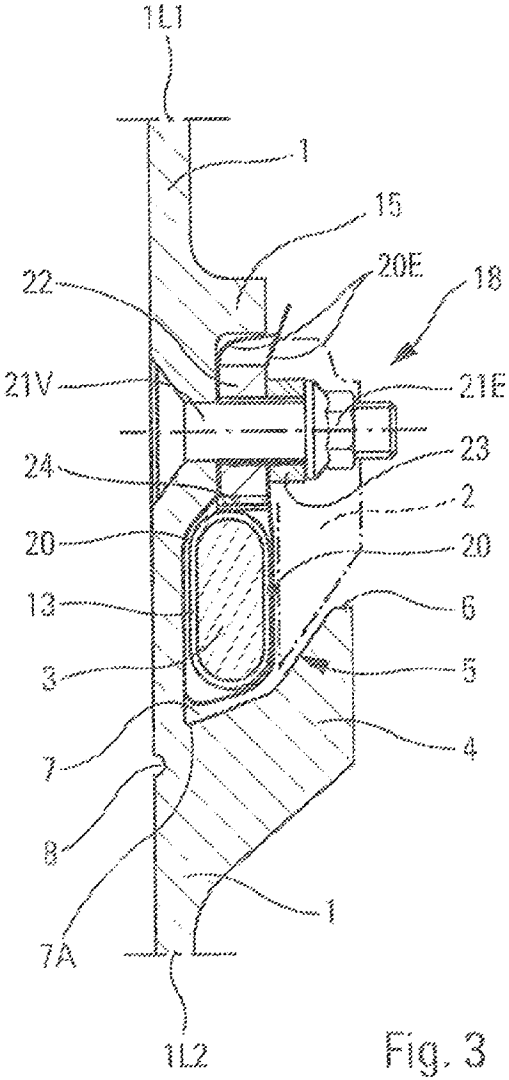
FIGS. 2 and 3 are views in transverse cross-section of the part shown in FIG. 1, along the lines II-II and III-III respectively of FIG. 1.
Figure 2:
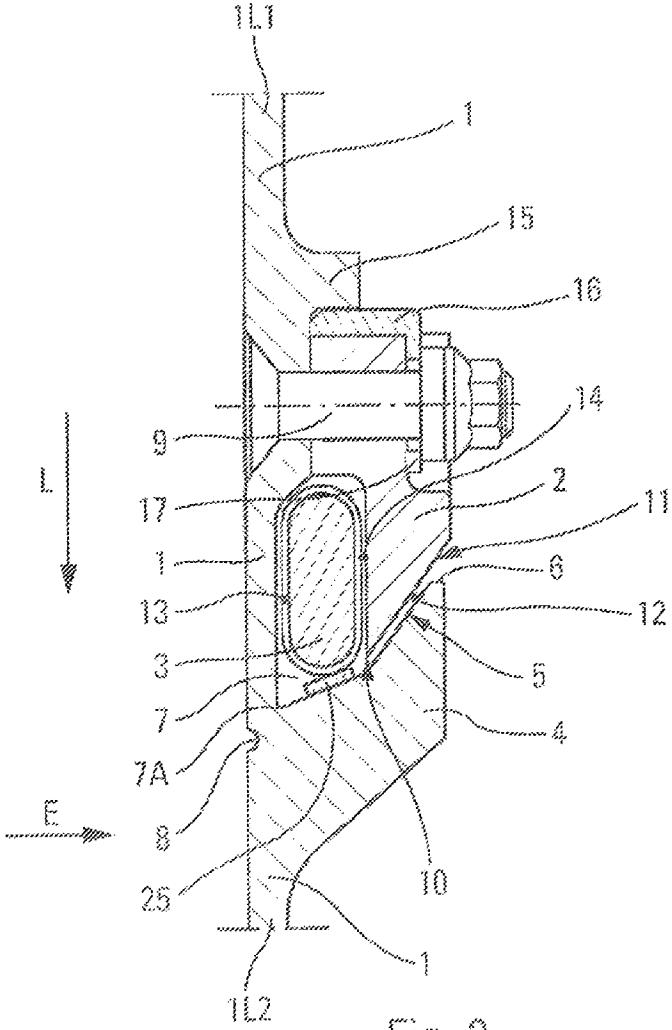

The pyrotechnic separation part, shown in FIGS. 1 to 3 and according to the present invention, has a base section 1, a plurality of portions of an anvil section 2—only two of which are shown in FIG. 1—and a pyrotechnic detonating fuse 3. The section 1 and the section portions 2 are made, for example, of aluminium and said part can be rectilinear, curvilinear, cylindrical, etc., depending on the required shape of the cutting line between two elements (which are not shown) positively connected in any known manner to the longitudinal edges 1L1 and 1L2 of the base section 1. This base section 1 is part of the structure formed by said elements and transmits mechanical forces between them.

The base section 1 has a projecting longitudinal heel 4, shaped like a hook, provided with a plane longitudinal facet 5 on the inner face of its free end 6. The longitudinal facet 5 is inclined and diverges towards the outside of the hook formed by said heel 4. Furthermore, the base section 1 is provided with a longitudinal channel 7 with an inclined base determining with said base section 1 a longitudinal base groove 7A, with a small radius of curvature, said longitudinal channel 7 being disposed on the side of the concavity of said heel 4 and an end-of-rupture groove 8 being made in said base section 1 on the side opposite said channel 7.

The anvil section portions 2 are added to the base section 1 one after another, the facing transverse end edges 2D and 2G of two consecutive portions 2 being at least approximately in abutment. These section portions 2 are positively connected to the base section 1 by bolts 9, passing through the base section 1 and said section portions 2 and distributed along the length thereof. These anvil section portions 2 have, on the outer face of their end, an inclined plane longitudinal facet 11 converging towards the inside of the hook formed by the heel 4.

The free longitudinal end 10 of the anvil section portions 2 penetrates the hook formed by the heel 4, in such a way as to close said channel 7, the inclined facets 5 and 11 being then opposite one another, but spaced by a predetermined clearance of a few tenths of a millimeter.

The base section 1 also has a projecting longitudinal rib 15 against which said anvil section portions 2 rest, on the face opposite their free longitudinal end 10, via a plurality of discontinuous blocks 16 distributed along the length of the section 1 in correspondence with said bolts 9. Lugs 17 are provided to allow the blocks 16 to be fixed, for example via the bolts 9.

On the inside of said channel 7 thus closed there is disposed said longitudinal pyrotechnic fuse 3, the outer casing 13 of which is positioned axially, parallel to the direction L corresponding to the width of said sections 1 and 2, via lower positioning studs 25 (disposed generally by gluing to the bottom of the channel of the heel) and via fixing means 18 distributed along the length of said base section 1 and disposed between the consecutive section portions 2. To that end, the facing transverse edges 2D and 2G of two consecutive portions 2 have indentations 19D and 19G to accommodate said fixing means 18, which are independent of the fixing means 9.

Each fixing means 18 has a rigid or semi-rigid tie, which in this embodiment takes the form of a metal strip 20, forming a loop closely surrounding the pyrotechnic fuse 3. The ends 20E of the metal strip 20 are fixed to said base section 1 by a bolt 21, the screw 21V of which passes through said ends 20E and the base section 1 and the nut 21E of which holds said ends 20E against said base section 1, maintaining a clearance at the fixing point of said ends 20E in order to allow the metal strip 20 to translate vertically and to prevent it from breaking when the pyrotechnic fuse 3 is actuated. A spacer plate 22 is disposed between said ends 20E of the metal strip 20 and a screw backing plate 23 is disposed between the nut 20E and the ends 20E.

In addition, a positioning stud 24 is disposed between the spacer plate 22 and the pyrotechnic fuse 3.

A positioning stud 24 of this kind ensures the integrity of the pyrotechnic fuse 3, during its operation, by isolating it.

Thus, the holding and the positioning of said pyrotechnic fuse 3, in the channel 7, are independent of the fixing of said section portions 2 (anvils) to the base section 1 (heel) and it is easy to fit the anvils 2 taking into account the adjustments to be made to the clearance 12 in order to obtain a clearance gap 14, parallel to the direction E corresponding to the depth of the sections 1 and 2, between the outer casing 13 of the pyrotechnic fuse 3 and the walls of the channel 7, which is nil (contact) or almost nil. A clearance 14 of this kind can, for example, be approximately a few tenths of a millimeter.

On being ignited, the detonating fuse 3 produces shock waves orthogonal to itself, these waves setting its casing 13 in motion and leading to the expansion of the cross-section thereof.

Under the effect of the detonation, the casing 13 is set in motion by shock wave, the clearance 14, parallel to the direction E, enabling this casing 13 to acquire a homogeneous velocity sufficient to produce, at the time of its impact on the sections 1 and 2, a shock wave capable of setting in motion the corresponding walls of said sections.

Setting in motion the section 1 initiates the rupture thereof along a separation line starting from said base groove 7A, with a small radius of curvature, of the channel 7 and leading into the end-of-rupture groove 8.

The clearance 12 between the inclined facets 5 and 11 allows the anvil section portions 2 to acquire a homogeneous velocity sufficient to produce, at the time of their impact with the heel 4, a shock wave capable of setting said heel in motion. The movement of the heel 4 of the section 1 enables the cutting along said separation line to be augmented.

Thus, the opposed movements of the heel 4 and the wall of the section 1 facing the casing 13 allows the section 1 to be cut.

When the inclined facets 5 and 11 are in contact with one another, the force exerted, parallel to the direction E, by the transverse swelling of the pyrotechnic fuse has a component, parallel to the face 5 of the heel 4, that is applied to the section 2 and which facilitates the coming apart, parallel to the direction L, of the two portions of the section 1 disposed either side of said separation line.

Of course, this component parallel to the face 5 tends to shear the bolts 9 and to deform them by bending due to the tilting of the section portions 2. However, because the section portions 2 rest against the rib 15, said bolts 9 are prevented from shearing and only a tilting, limited in amplitude, of the section portions 2 takes place opposite the section 1.

Thus, an easy separation of the section 1 into two parts is obtained.

The detonating pyrotechnic separation part according to the invention thus consists of two independent sub-systems, each dedicated to a predetermined function, namely:

firstly, the sub-system for holding the fuse, made up of the fixing device 21, the spacer plate 22 and the positioning stud 24, this sub-system allowing the fuse to be held so that it rests on the lower studs 25 (situated at the bottom of the channel 7 of the heel), which makes the part reversible and thus suitable for implementation on a space launch vehicle for which the direction of flight can correspond either to the normal direction (heel pointing upwards) or the opposite direction (heel pointing downwards); and secondly, the sub-system for trapping the fuse, consisting of the fixing device 21 (or even another fixing device independent of the fixing device 21), the screw backing plate 23 (enabling the tie 20 to be held without gripping it) and the tie 20, this sub-system enabling the fuse to be trapped with the cut portion to which the trapping sub-system is fixed, which ensures that, after cutting, all the components remain attached to one or other of the cut portions thus preventing any interference.

The invention claimed is:

1. Detonating pyrotechnic separation part with:

a first section (1) forming the base of said part and provided with a longitudinal projecting rib (15), and with a hook-shaped longitudinal projecting heel (4) delimiting a longitudinal channel (7) in its concavity, said heel (4) having, on the inner face of its free end (6), a first plane longitudinal facet (5), divergently inclined towards the exterior of the hook formed by said heel (4);

a longitudinal pyrotechnic fuse (3) disposed in said channel (7); and a second section added to said first section (1) and made integral therewith via first fixing means (9) distributed along the length of said first and second sections, said second section resting, via one of its longitudinal edges, against said projecting longitudinal rib (15) via blocks (16) and being provided, on the outer face of its other longitudinal edge, with a convergently-inclined second plane longitudinal facet (11) disposed opposite said first facet (5) while being distant therefrom by a first predetermined clearance (12), enabling said second facet to cooperate with said first facet during the rupture of said part, said second section thus closing said channel (7), in which said pyrotechnic fuse (3) is accommodated with a second predetermined clearance gap (14) parallel to the depth (E) of said first and second sections, and being capable of serving as anvil to said pyrotechnic fuse (3), wherein:

said second section consists of a plurality of consecutive section portions (2), fixed one after another onto said first section (1) via said first fixing means (9); and there are provided, between said consecutive section portions (2), second fixing means (18), distributed along the length of said first section (1) and independent of said first fixing means (9), making it possible to fix and position said pyrotechnic fuse (3) relative to said first section (1).

2. Detonating pyrotechnic separation part according to claim 1, wherein the facing transverse end edges (2D, 2G) of two consecutive portions (2) are at least approximately in abutment and at least one of said transverse edges (2D, 2G) has an indentation (19D, 19G) to accommodate the corresponding second fixing means (18).

3. Detonating pyrotechnic separation part according to claim 1, wherein each of said second fixing means (18) has a rigid or semi-rigid tie (20) which forms a loop closely surrounding said pyrotechnic fuse (3) and the ends of which (20E) are fixed to said first section (1).

4. Detonating pyrotechnic separation part according to claim 3, wherein said rigid or semi-rigid tie (20) is a metal strip.

5. Detonating pyrotechnic separation part according to claim 3, wherein a spacer plate (22) is disposed between the ends (20E) of said rigid or semi-rigid tie (20) and said ends (20E) are fixed to said first section (1) by at least one bolt of which the screw (21V) passes through said ends (20E), said spacer plate (22) and said first section (1) and of which the nut (21E) holds said ends (20E) against said spacer plate (22) and said first section (1).

6. Detonating pyrotechnic separation part according to claim 5, wherein a positioning stud (24) is disposed between said spacer plate (22) and said pyrotechnic fuse (3).

* * * * *